United States Patent [19]

Miller

[11] 4,373,607

[45] Feb. 15, 1983

[54] LOUDSPEAKER CONE STIFFENERS

[76] Inventor: Charles D. Miller, P.O. Box 790126, Dallas, Tex. 75379

[21] Appl. No.: 276,810

[22] Filed: Jun. 25, 1981

Related U.S. Application Data

[63] Continuation-in-part of Ser. No. 63,379, Aug. 3, 1979, abandoned.

[51] Int. Cl.[3] ..... H04R 7/00

[52] U.S. Cl. ..... 181/166

[58] Field of Search ..... 181/166, 171–174; 179/115.5 R, 115.5 ES, 181, 115 R, 180

[56] References Cited

U.S. PATENT DOCUMENTS

| | | | |
|---|---|---|---|
| 2,002,189 | 5/1935 | Round et al. | 179/115.5 R |
| 2,513,171 | 6/1950 | Hassan | 181/171 |
| 2,641,329 | 6/1953 | Levy et al. | 181/171 |
| 3,701,865 | 10/1972 | Carlson et al. | 181/171 |
| 4,115,667 | 9/1978 | Babb | 179/115.5 VC |

*Primary Examiner*—L. T. Hix
*Assistant Examiner*—Thomas H. Tarcza
*Attorney, Agent, or Firm*—Hubbard, Thurman, Turner & Tucker

[57] ABSTRACT

An improved loudspeaker cone construction and method of improving performance comprises the use of one or more stiffener columns positioned across and attached to a loudspeaker cone at points intermediate small and large ends of the cone. A plurality of stiffener columns may be arranged in one or more cross shaped arrays or one or more polygon shapes, and attached to the cone in a plane perpendicular to a central axis of the cone. The stiffener rods reduce self-resonances within the cone and improve stiffness to generally improve performance.

12 Claims, 5 Drawing Figures

LOUDSPEAKER CONE STIFFENERS

BACKGROUND OF THE INVENTION

This application is a continuation-in-part of my U.S. application Ser. No. 063,379, filed Aug. 3, 1979 now abandoned.

This invention relates to improved loudspeaker construction and methods of assembly and more particularly to a loudspeaker having improved cone construction including stiffener rods positioned across the cone.

Prior art known to the Applicant and believed to be relevant to the present invention includes: U.S. Pat. No. 2,513,171 issued to Hassan on June 27, 1950 and U.S. Pat. No. 4,115,667 issued to Babb on Sept. 19, 1978. Both of these patents deal with improvements intended to better couple acoustic energy from a voice coil to outer portions of a loudspeaker cone. In Hassan, struts extend from the voice coil to at least one cross-beam placed across the cone at some distance from the voice coil. The purpose of the arrangement is to directly couple energy through the struts and cross-bar to the outer portions of the cone. In Babb, a plurality of rib-members are attached perpendicularly to the cone surface extending from the voice coil to the outer portions of the cone. The ribs are intended to better couple acoustic energy directly from the voice coil to these outer portions of the cone.

Generally speaking, a loudspeaker comprises some form of elastic diaphragm, or elastically suspended diaphragm, driven by some type of electromechanical transducer, typically a voice coil comprising a wire coil suspended within a magnetic field. The voice coil mechanically drives the diaphragm which in turn couples energy to the surrounding air to hopefully provide a good reproduction of the signal driving the voice coil. The actual nature of the sound produced by the loudspeaker is influenced by the characteristics of the surrounding air, the type of enclosure surrounding the loudspeaker and also by any resonant properties of the diaphragm itself. A loudspeaker diaphragm preferably has a large area, low mass, high stiffness and minimal resonances if it is to provide a good reproduction of sound. The large area is needed to provide good coupling at relatively low frequencies, but at the same time, low mass is required to provide the rapid diaphragm acceleration and decelaration needed for high frequency performance. High stiffness of the diaphragm increases overall efficiency and raises the frequency of diaphragm resonances, hopefully above a normal audible range. In most modern speakers, the diaphragm itself is constructed of a porous blotter-like paper material which has inherent self-dampening characteristics to thereby attenuate internal resonances.

The usual compromise between area and weight is achieved by forming the diaphragm in the shape of a section of the surface of a solid body such as a cone, an ellipsoid, a paraboloid or some other shape. All such three dimensional diaphragms are normally referred to as speaker cones and will be referred to as such herein. Such shapes are known to be the best compromise in loudspeaker design but still fail to provide extremely wide range performance. In most loudspeakers having relatively large cones, the high frequency performance is limited by a natural decoupling of the outer portions of the cone from the voice coil at the high frequencies. That is, while the voice coil may be driving the small end of the cone at a high frequency rate, the energy does not effectively travel through the cone to the outer portions so that only a small percentage of the cone area actually radiates at the high frequencies. Arrangements are known in which the central portion of the cone is intentionally decoupled from the outer portions by a compliance which allows only low frequency energy to be coupled to the larger portion of the cone at the outer edges.

As noted with respect to the above-referenced patents, attempts have been made to add mechanical elements for coupling energy directly from the voice coil to the outer portions of the speaker cone. It is apparent that any such added mechanical elements increase the weight of the cone structure and the prior metal strut and spider arrangements can increase the weight substantially. Any substantial increase in weight reduces the high frequency performance due to inertial and damping effects. Since, as noted above, the general problem encountered with large speakers is the inability to couple high frequencies to the outer and larger portions of the cone, these prior attempts have not proven practical and have not been widely accepted.

Prior art stiffening structures utilizing support struts coupled directly from the speaker voice coil to cross beams have several additional drawbacks. One drawback is that substantial weight is added to the cone structure, which can cause voice coil centering problems. Also, the use of cross beams tends to create distortion in the cone due to flexing of the beams. Large forces are exerted on the beams by the support struts, which causes the ends of the beams to move inwardly and undesirably flex the cone. Yet another drawback is related to the varying propogation speeds through the support struts and cone material, which causes phasing differences between the inner and outer portions of the cone.

SUMMARY OF THE INVENTION

Accordingly, an object of the present invention is to provide an improved loudspeaker cone construction.

Another object of the present invention is to provide a method for improving cone stiffness in loudspeakers, to improve overall performance with minimal increase in cone weight.

Another object of the present invention is to provide improved loudspeaker cone construction which may be incorporated in newly manufactured loudspeakers or may be added to previously manufactured loudspeakers.

An improved loudspeaker, according to the present invention, includes a cone having one or more light weight stiffener columns positioned essentially perpendicular to a central axis of the cone and rigidly attached to the cone surface at points intermediate a small and large end of the cone. The stiffener columns reduce internal resonances and generally improve cone stiffness to result in improved performance with minimal increase in cone weight.

BRIEF DESCRIPTION OF THE DRAWINGS

The present invention can be better understood by reading the following detailed description of the preferred embodiments with reference to the accompanying drawings wherein.

DESCRIPTION OF THE PREFERRED EMBODIMENTS

Figure 1:
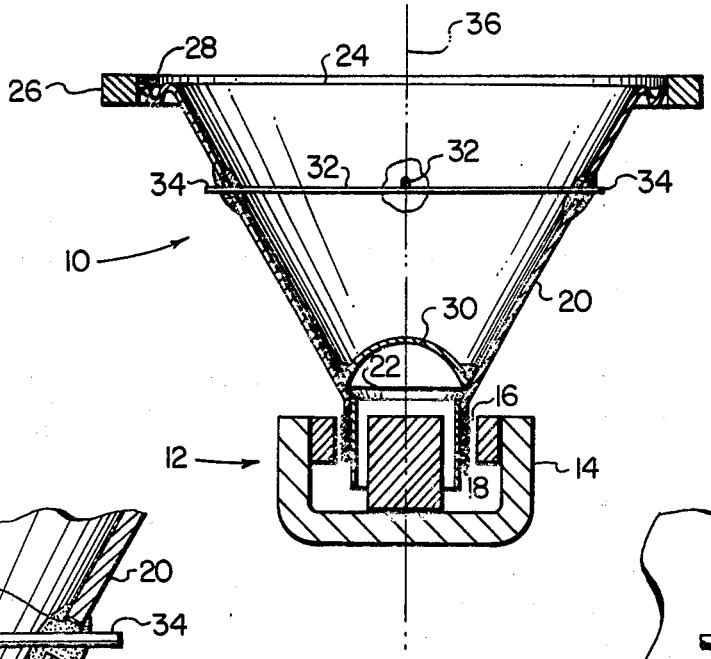
FIG. 1 is a cross-sectional illustration of a loudspeaker with a pair of stiffener columns in accordance with the present invention.

With reference now to FIG. 1, there is illustrated in cross-sectional form a complete loudspeaker comprising a conical diaphragm designated generally 10 and a voice coil structure designated generally 12. The voice coil structure 12 is illustrated as a magnet arrangement 14 providing a magnetic field in a gap 16 within which is positioned a cylindrical coil 18. Coil 18 is typically formed on a light weight dielectric cylinder carried in the gap 16. The speaker diaphragm 19 comprises a simple section of a cone 20 having a small end 22 connected to the voice coil and a large end 24 open to the surrounding air for transmission of acoustic signals. The large end 24 is normally supported from a surrounding framework 26 by some form of decoupling compliance 28. The magnetic structure 14 and framework 26 are typically rigidly interconnected and supported within some form of speaker housing in a conventional manner. A generally spherical voice coil dust cover 30 is often provided at the small end 22 of the cone 20 to both provide protection for the voice coil 18 and to act as a sound transmitter for high frequency sounds.

In accordance with the present invention, a pair of stiffener columns 32 are provided in a cross pattern having ends 34 attached to the cone 20. Each of the columns 32 is positioned essentially perpendicular to a central axis 36 of the diaphragm 10 so that it has essentially no direct effect in the transmission of acoustic energy from the coil 18 to the cone 20. Columns 32 are preferably formed from very stiff, but light weight, material and are intended to prevent any internal resonances which would, for example, allow the surface of cone 20 at the ends 34 of rods 32 to move either away from or towards each other. This is believed to be a typical form of internal resonances or oscillation of the cone 20 which degrades performance in a normal speaker. A single stiffener rod such as one of the columns 32, illustrated in FIG. 1, aids in preventing oscillations, both in the direction of the rod and at right angles thereto. That is, in a typical case, any movement of the surfaces of cone 20, at points 34, away from each other would be accompanied by movement of the surfaces of cone 20 at points ninety degrees displaced from points 34 towards each other. Thus, if a single column 32 prevents the motion in one direction, it reduces or eliminates motions at the ninety degree locations also. However, for the most rigid structure, a pair of stiffener columns 32, as illustrated in FIG. 1, are preferred.

Figure 2:
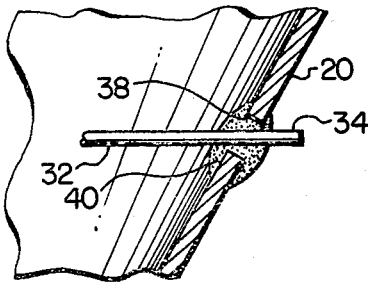
FIGS. 2 and 3 are cross-sectional illustrations of methods of attachment of the stiffener columns to the conical diaphragm in FIG. 1.

FIG. 2 is a detailed cross-sectional illustration of the attachmnent of rods 32 to cone 20. In an experimental form, apertures 38 were formed through cone 20 so that the ends 34 of column 32 was actually inserted through the cone 20. An adhesive 40, which is preferably a rigid material such as an epoxy resin type adhesive is used to completely fill the space between column 32 and the walls of apertures 38 and to additionally cover both inner and outer surfaces of the cone 20 for a short distance on all sides of apertures 38. Such an adhesive arrangement is found to be extremely rugged and spreads the attachment point of the column 32 to the cone 20 over a sufficiently large area to prevent tearing of the cone 20 under normal operations.

Figure 3:
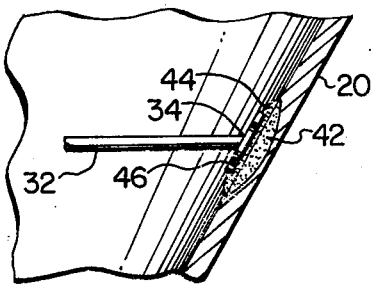

FIG. 3 illustrates an alternate arrangement for attachment of columns 32 to the cone 20. In this arrangement, adhesive is preferably applied to the cone 20 in two different layers. A first layer of a realtively thin adhesive is preferably applied to cone 20 to penetrate the cone and provide a reinforced layer 42 within the cone 20 itself. An adhesive which has been found to effectively penetrate the blotter-like material of commercially available loudspeakers is a cyanoacrylate material. A second layer of adhesive 44, such as an epoxy resin, is then applied to the cone 20 over the reinforced area 42. The column 32 is then positioned in the cone such that its end 34 is within the adhesive 44 and is thereby attached to the cone 20. For such a surface attachment arrangement, it may be preferred that a thin disc 46 be manufactured integrally with the column 32 to provide a larger area for attachment to cone 20 by the adhesive 44.

Rubbery cements, such as silicone rubber, have been employed in experimental models of the present invention, but are not preferred for several reasons. The flexible adhesive is found to not provide as good a stiffening effect since it allows some movement of the cone 20 relative to the stiffener column 32. The rubbery cement additionally does not tend to penetrate the cone material 20 to any great extent and thus, may be pulled from the surface of the cone too easily.

Figure 4:
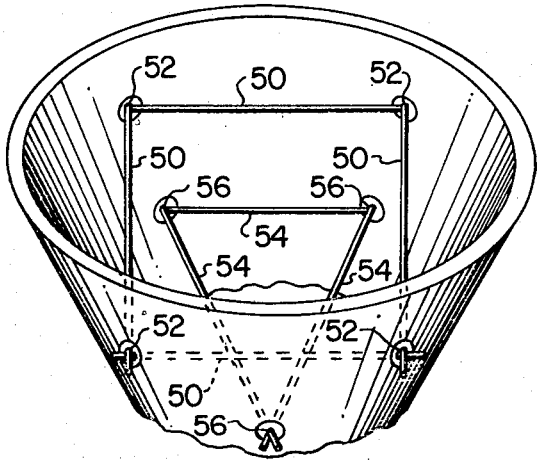
FIG. 4 is a perspective view of a loudspeaker cone with a pair of stiffener column arrays attached to the cone.

With reference now to FIG. 4, a perspective view of a loudspeaker cone 48 is illustrated with a pair of arrays of stiffener columns aranged in the form of a square and a triangle attached to the cone 48. In particular, a first set of stiffener columns 50 are arranged in a square pattern which is attached to the cone 48 at points 52, all of which lie essentially in a plane which is perpendicular to a central axis of cone 48. A second array of three stiffener columns 54 arranged in the shape of a triangle is shown attached to cone 48 at points 56 which also lie in a second plane essentially perpendicular to an axis of the cone 48. The attachment of the stiffener columns 50 and 54 to the cone 48 at points 52 and 56 can be made in a manner similar to the FIG. 2 arrangement with a pair of the columns passing through each of the apertures in the cone 48. This FIG. 4 arrangement was installed in a loudspeaker having an outer diameter of 10 inches with the square array positioned near the outer edge and the triangular array nearer the voice coil. Since the columns 54 are, therefore, much shorter than the columns 50, they may be of much lighter weight and lower strength material and are believed to have aided primarily in improving high frequency performance of the speaker.

Figure 5:
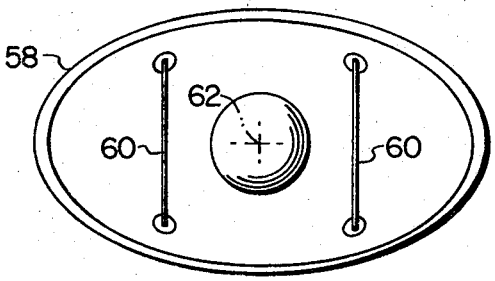
FIG. 5 is a plan view of an ellipsoid loudspeaker cone having a pair of stiffener columns in accordance with the present invention.

With reference now to FIG. 5, there is illustrated a generally elliptical loudspeaker cone 58 of the type typically employed in automotive and other portable applications. As illustrated in FIG. 5, a pair of stiffener columns 60 are attached to the cone across its shorter dimension. The columns 60 may be attached to cone 58 in the manner illustrated in FIG. 2 or 3 or any other suitable manner. In this case, it is believed preferable that the two columns 60 be positioned parallel to each other with each of the columns 60 positioned essentially perpendicular to a central axis 62 or the cone 58. Since an ellipsoid type speaker cone 58 is generally used in the lower priced market, it may be preferable to use a single stiffener column 60 actually passing through the central axis 62, and a considerable improvement in performance should result.

In the development of the present invention, a number of materials were employed for use as stiffener columns according to the present invention. Initially, balsa wood columns were found to provide an improvement in speaker performance but were found to lack sufficient strength and stiffness to provide a self resonance above the desired audio spectrum. Fiberglass epoxy laminates were found to provide much higher strength than the balsa wood columns but also were of much greater weight and, therefore, were also not totally suitable. The best form of fiberglass epoxy laminates found for use in the present invention was that of a thin walled hollow tube of cylindrical cross section since this provided the greatest strength with the minimum weight. The most suitable materials found for use in the present invention were solid rods of graphite fiber and epoxy composite materials. Such materials have much higher strength to weight ratios than even the fiberglass epoxy laminates and, therefore could be provided with self resonances above the audio spectrum of interest. The graphite epoxy rods were found to be available from the Graftek Division of Exxon Enterprises, Inc. of Raleigh, N.C.

As noted above, the purpose of the stiffener columns in the present invention is to prevent internal vibrations within the loudspeaker diaphragm itself and as a result, increase cone stiffness. By increasing cone stiffness, the cone itself becomes more efficient at coupling energy from the voice coil to all parts of the cone. In increasing cone stiffness, the stiffener columns of the present invention do not actually couple any of the energy from the voice coil to the rest of the cone. The increase in cone stiffness is also measurable in terms of the radiation impedance of a speaker. Increasing stiffness increases the radiation impedance because the cone better couples energy to the surrounding air. The increase in stiffness also increases the dynamic range and effective power handling capabilities of the speaker. Internal oscillations of the diaphragm increase at higher power levels as well as at higher frequencies. The increase in stiffness provided by the present invention therefore allows speakers to be driven to higher power levels before the internal oscillations, or break ups, become noticeable.

Precise placement of the stiffener column or array of columns in a loudspeaker cone is determined by a number of factors but generally is at some point intermediate the small and large ends of the cone. The columns 32 are preferably placed near the point of maximum deformation of the speaker cone 20. With reference to FIG. 1, it is seen that at the small end of the cone 22, the voice coil and dust cover 30 tend to stiffen the cone and maintain constant shape. In similar fashion, the large end of cone 24 has its shape somewhat controlled by the frame 26 and compliance 28 which supports the cone. Triangular stiffener arrays have been employed with good results in a ten inch diameter cone when positioned at approximately 60% of the distance between the small end 22 and the large end 24, approximately at the location of the columns 32 of FIG. 1. The best location of the stiffener columns can be expected to vary dependent upon the shape and construction of the cone and the materials used in both the cone itself and the stiffener columns 32. In general, the stiffener columns should be positioned at the location of the maximum amplitude of internal oscillations of the cone.

As noted above, minimum weight is one of the desirable attributes of a loudspeaker diaphragm. In some experimental speakers, the dust cover 30 (FIG. 1) has been removed to reduce cone weight so that the total weight, with stiffener columns, is no greater than the original speaker cone weight. Another way of minimizing total cone weight is to place the stiffener columns of the present inventions as closely to the small end of the cone as is consistent with the other purposes of the invention. As the stiffener columns are positioned closer to the small end 22, their weight decreases since the required length decreases. Additionally, the diameter of the columns can be reduced since the required strength of the column material is inversely proportional to the square of its length. Thus, the weight of the stiffener columns can be decreased by a much greater factor than would be apparent since as the length decreases, the diameter may also be decreased to further reduce the weight.

A performance improvement can be achieved using stiffener columns which add very little weight to the loudspeaker diaphragm as the following example shows. A square array, like rods 50 in FIG. 4, was installed in a ten-inch conical diaphragm speaker with good results. The columns were solid cylinders of the graphite fiber epoxy material having a diameter of about 0.035 inches and length of about 3.75 inches. The overall weight of the four columnms was about 0.5 grams, which is believed to be less than 5% of the effective mass of the cone. A comparison test of a modified speaker showed an improvement in reproduction.

It can be seen that the strength of the stiffener columns is not determined solely by the amount of force which must be transferred along the column from one side of the speaker cone to the other. This longitudinal tensile and compressive force is the primary force which the columns must withstand but additionally, the columns must move laterally with the speaker in its normal operation. Any lateral forces generated are not great, however, because the columns do not bear a direct lateral thrust from members moving approximately in the direction of voice coil movement. A reasonably high strength to weight ratio will prevent flexing of the columns 32 as the cone 20 moves, avoiding the generation of internal oscillations within the cone 20. Any oscillations which do occur should be at a frequency above the normal audio range of the speaker so that they have no effect on the produced sound. If the natural resonant frequency of the stiffener columns is sufficiently high, there will be no source of excitation in normal use and as a result, there should be little, if any, oscillation of the column even above the audible range. It is for these reasons that the graphite fiber composite materials, which have excellent strength to weight ratios and tremendous stiffness, are preferred for use as the stiffener columns of the present invention.

The absence of any direct coupling between the voice coil 18 and the columns of the present invention has a number of important advantages. The present invention can be utilized by attachment to existing speakers as well as incorporated into new speakers during their fabrication. The light weight and high stiffness of the columns minimizes de-centering hazards and greatly improves frequency response, power handling capabilities and dynamic range. Since there is no direct coupling between the columns and the voice coil, only small lateral forces act upon the columns, which minimizes possible distortion due to column flexing.

As an alternate embodiment of the present invention, the polygon and cross shaped stiffener patterns may be fabricated from a single piece of material instead of a plurality of independent columns. This arrangement gives stiffness and light weight, with all the advantages of the above embodiment, and has the added advantage of ease of installation, which cuts labor costs associated with the utilization of the present invention.

While the present invention has been illustrated and described in terms of specific apparatus and methods of construction, it is apparent that various modifications and changes can be made within the scope of the present invention as defined by the appended claims.

What is claimed is:

1. An improved loudspeaker comprising:

a generally conical diaphragm, acoustic driving means coupled to a small end of said diaphragm, and a plurality of stiffener columns positioned in a plane essentially perpendicular to a central axis of said diaphragm and said columns having ends attached to said diaphragm intermediate said small end and a large end of said diaphragm, wherein said plurality of columns is positioned end to end to form a polygon.

2. An improved loudspeaker according to claim 1 wherein said polygon is an equilateral triangle.

3. An improved loudspeaker according to claim 1 wherein said polygon is a square.

4. An improved loudspeaker according to claim 1 wherein said columns form a unitary structure.

5. An improved loudspeaker according to claim 1 wherein said columns are attached to said diaphragm by means of adhesive.

6. An improved loudspeaker according to claim 5 wherein the ends of said stiffener columns are positioned in an aperture through said diaphragm and said adhesive contacts the inner and outer surfaces of said diaphragm and fills the space between said column and the walls of said aperture.

7. An improved loudspeaker according to claim 1 wherein said columns have a self resonance above an audio frequency range of said loudspeaker.

8. An improved loudspeaker according to claim 1 wherein said columns comprise cylindrical rods of graphite fiber composite.

9. A method of improving the performance of a loudspeaker of the type having a generally conical diaphragm and driving means coupled to a small end of said diaphragm, comprising, attaching ends of a plurality of stiffener columns to said diaphragm at points intermediate the small end and the large end of said diaphragm and spaced substantially the same distance from said small end, and positioning said columns end to end to form a polygon in a plane perperndicular to a central axis of said generally conical diaphragm.

10. A method according to claim 9 wherein said plurality comprises three columns of equal length and said polygon comprises an equilateral triangle.

11. An improved loudspeaker comprising:

a generally conical diaphragm having a central axis;

acoustic driving means coupled to a small end of said diaphragm; and at least one stiffener column, wherein said stiffener columns are coupled to said diaphragm at points intermediate the small end and a large end thereof, and further wherein said diaphragm is the only energy transferring member coupled to said stiffener columns which is also coupled to said driving means, whereby all energy transferred to said stiffener columns is transferred through said diaphragm.

12. An improved loudspeaker according to claim 11, wherein said columns comprise a unitary structure having the form of a plurality of columns coupled together.

* * * * *